US007339541B2

(12) United States Patent
Schadler

(10) Patent No.: US 7,339,541 B2
(45) Date of Patent: Mar. 4, 2008

(54) WIDEBAND CAVITY-BACKED ANTENNA

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/819,961

(22) Filed: Apr. 8, 2004

(65) Prior Publication Data

US 2004/0189539 A1 Sep. 30, 2004

Related U.S. Application Data

(63) Continuation-in-part of application No. 10/252,429, filed on Sep. 24, 2002, now Pat. No. 6,756,949.

(51) Int. Cl.
*H01Q 1/12* (2006.01)
*H01Q 13/00* (2006.01)

(52) U.S. Cl. ..... 343/772; 343/891

(58) Field of Classification Search ..... 343/789, 343/771, 772, 776, 890, 891, 786
See application file for complete search history.

(56) References Cited

U.S. PATENT DOCUMENTS 2,431,124 A * 11/1947 Kees et al. ..... 343/752
2,573,401 A * 10/1951 Carter ..... 343/711
2,778,014 A * 1/1957 Rowland ..... 343/770
3,177,491 A * 4/1965 Rateau ..... 343/786
3,210,694 A * 10/1965 Ehlers ..... 333/21 R
3,460,149 A * 8/1969 McMahon ..... 343/768
4,821,040 A * 4/1989 Johnson et al. ..... 343/700 MS
5,010,348 A * 4/1991 Rene et al. ..... 343/700 MS
5,539,418 A * 7/1996 Egashira et al. ..... 343/712
6,150,988 A 11/2000 Sinclair et al. ..... 343/767
6,388,633 B1 * 5/2002 Imaizumi et al. ..... 343/776

* cited by examiner

*Primary Examiner*—Michael C. Wimer
(74) *Attorney, Agent, or Firm*—Baker & Hostetler LLP

(57) ABSTRACT

An antenna system is disclosed that includes a mast, waveguides positioned about the mast, and a feed system positioned external to the mast and between adjacent waveguides, such the feed system can be easily serviced. The waveguides include radiator elements that are easy to manufacture, and thus reduce the cost associated with wide-band cavity-backed antennas. Further, adjustable disc-like and spherical radiating elements for exciting the fields in the waveguides are also disclosed. DC voltage buildup on the radiating elements are grounded by an easily attachable coaxial structure.

9 Claims, 7 Drawing Sheets

WIDEBAND CAVITY-BACKED ANTENNA

This non-provisional Continuation-in-Part application claims the benefit and priority of U.S. patent applicatcn Ser. No. 10/252,429 U.S. Pat. No. 6,756,949, filed Sep. 24, 2002, and issued Jun. 29, 2004, titled, "A Wideband Cavity-Backed Antenna," by John L. Schadler, the content of which is incorporated by reference in its entirety.

FIELD OF THE INVENTION

The present invention relates generally to antenna systems. More particularly, the present invention is directed to an antenna system designed for multi-channel, broadband applications. The antenna of the present invention has a construction that achieves low windloads, and allows a feed system of the antenna system to be easily accessed for service.

BACKGROUND OF THE INVENTION

Under the rules of the Federal Communication Commission, by the year 2006, television broadcasters are required to transition from current National Television System Committee (NTSC) antenna systems to digital television (DTV) antenna systems. NTSC antenna systems are analog systems, and during operation of analog NTSC systems only one television transmission signal is transmitted per channel.

DTV is a new type of broadcasting technology. DTV antenna systems transmit the information used to make television pictures and sounds by data bits, rather than by waveforms, as performed by NTSC systems. With DTV, broadcasters will be able to provide television programming of a higher resolution and better picture quality than what can be provided under the current analog NTSC antenna systems. In addition, DTV broadcasters will be able to transmit more than one signal per channel, and thus, deliver more than one television program per station.

All current analog TV broadcasts will be phased out by the end of 2006. During the transition to DTV, television broadcasters are faced with having to transmit on two channels simultaneously, (NTSC and DTV).

Historically, panel antennas are utilized for multi-channel, wideband/broadband applications. One disadvantage of panel antennas is that they exhibit higher windloads than conventional single channel antennas, such as the slotted coaxial type, due to the size of the panel assemblies attached to an antenna mast. Further, the size of the panel antennas limit the amount of radiating assemblies that can be positioned around a mast, and consequently, the amount of flexibility in varying the overall azimuth pattern of panel antennas.

Wideband cavity-backed antennas are also utilized for multi-channel broadband applications. However, there are disadvantages associated with wideband cavity-backed antennas. For example, one conventional waveguide cavity-backed antenna utilizes a radiator element having a "T-shaped" geometry. The "T-shaped" radiator element is costly to manufacture because a significant amount of machining labor is required to construct the "T-shaped" radiator element.

Further, the design of the conventional wideband cavity-backed antenna is such that the assembly of the waveguides form the antenna mast-like structure, without use of a mast. The design also includes a feed system that is positioned within the hollow space formed when the waveguides are assembled together.

However, one drawback of the conventional wideband cavity-backed structure is that when the feed system requires service, the antenna has to be removed from its supporting structure and disassembled to access the feed system. Accordingly, interruption in television service to customers who are receivers of television signals transmitted by the antenna requiring service is prolonged by the time required to take down and disassemble the antenna to reach the feed system.

Further, the design of the conventional wideband cavity-backed antenna requires a capacitive disk, which is coupled to the "T-bar shaped" radiator element and separated from the waveguide by an air gap, along with a grounding rod to match the impedance of the transmission line to the impedance of the radiator element.

However, the air gap limits the amount of power that the radiator element is able to accommodate. The air gap, like a dielectric, is only able to accommodate a limited amount of power without breaking down. If the air gap breaks down and allows current to flow between the transmission line and the waveguide, the undesired current could potentially damage the radiating element.

Accordingly, it would be desirable to provide an antenna that may be utilized for multi-channel, broadcast applications that exhibits low windloads.

It would also be desirable to provide an antenna that allows for greater flexibility in varying the overall azimuth pattern of the antenna.

In addition, it would also be desirable to provide a multi-channel, broadband antenna that has high power handling capabilities.

Further, it would be desirable to provide a multi-channel, broadband antenna that allows for simplicity in impedance matching.

Moreover, it would be desirable to provide a multi-channel, broadband antenna that is cost-effective to manufacture and simple to service.

SUMMARY OF THE INVENTION

In one aspect of the present invention, an antenna system is disclosed that includes a cavity-backed broadside radiating waveguide, a center conductor of a coaxial feed protruding through a side wall of the waveguide and into the cavity of the waveguide, and a radiating disc element substantially perpendicular to a side wall of the waveguide and affixed to the center conductor, wherein a position of the radiating disc element on the center conductor is adjustable.

In another aspect of the present invention, an antenna system is disclosed, having an antenna support tower, an antenna mast attached to the tower, a cavity-backed broadside radiating waveguide attached to the mast, a cavity-backed broadside radiating waveguide, a center conductor of a coaxial feed protruding through a side wall of the waveguide and into the cavity of the waveguide, and a radiating disc element substantially perpendicular to a side wall of the waveguide and affixed to the center conductor, wherein a position of the radiating disc element on the center conductor is adjustable.

In yet another aspect of the present invention, a broadcast system is disclosed, having an antenna support tower, an antenna mast attached to the tower, a cavity-backed broadside radiating waveguide attached to the mast, a center conductor of a coaxial feed protruding through a side wall of the waveguide and into the cavity of the waveguide, and a transmitter coupled to the coaxial feed.

In yet another aspect of the present invention, an antenna system is disclosed, having a cavity-backed radiating means for radiating electromagnetic energy in a broadside manner, transmission line means for conveying electrical energy to the cavity-backed radiating means, field excitation means for exciting fields in the cavity-backed radiating means, wherein the excitation means is perpendicularly affixed to a center conductor of the transmission line means.

In yet another aspect of the present invention, an antenna system is disclosed, having a plurality of cavity-backed broadside radiating waveguides, a center conductor of a coaxial feed protruding through a side wall of each of the plurality of waveguides, and a plurality of radiating disc elements substantially perpendicular to a side wall of the plurality of waveguides and affixed to the center conductor.

In yet another aspect of the present invention a method for exciting a cavity-backed broadside radiating waveguide is disclosed, comprising the steps of placing a center conductor of a coaxial feed through a side wall aperture of the waveguide, attaching a radiating disc element to the center conductor, adjusting a position of the radiating disc element on the center conductor to enable proper excitation of radiating fields, and energizing the radiating disc element with a time-harmonic electrical signal.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
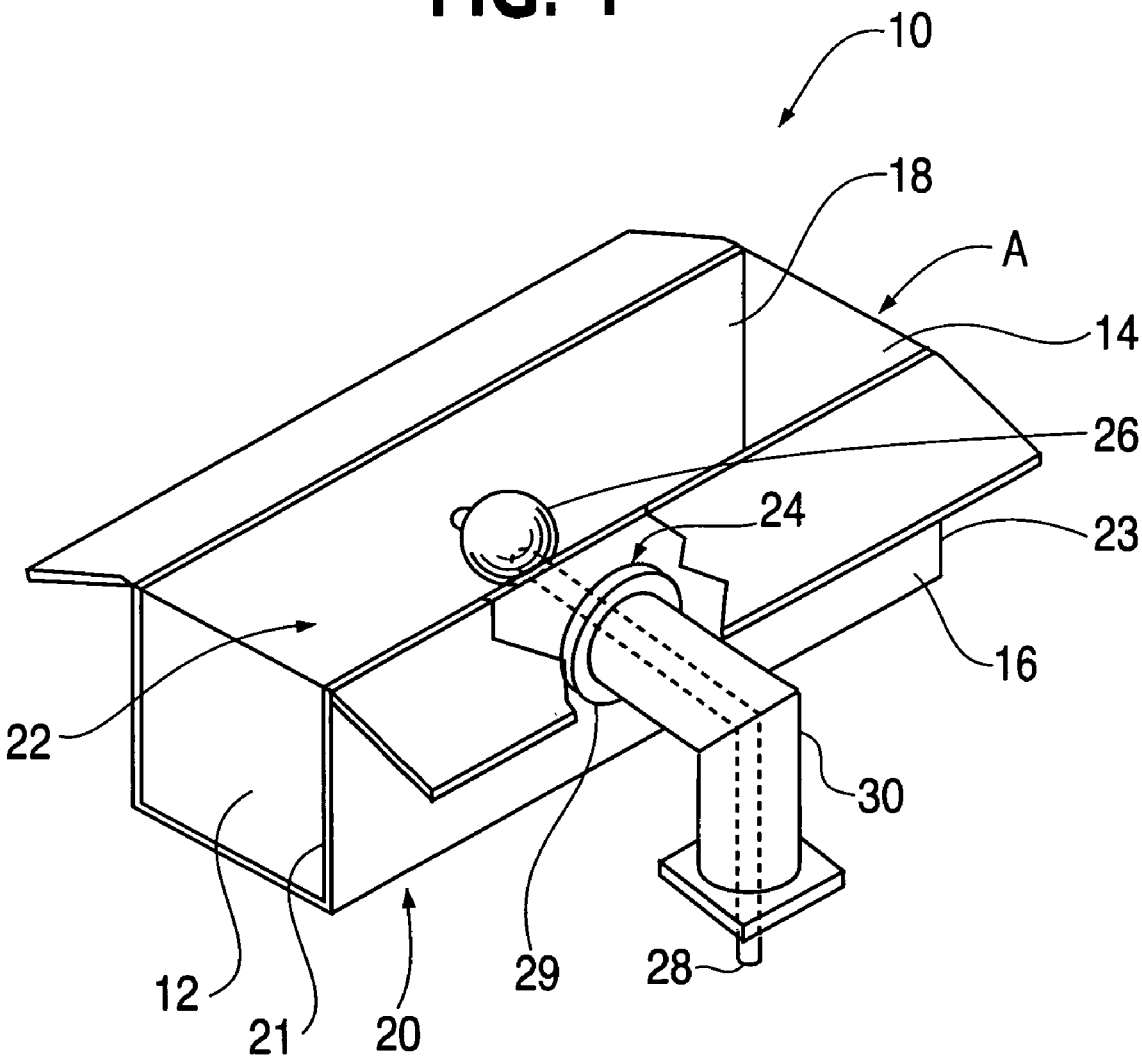
FIG. 1 is a perspective view of a wideband cavity-backed waveguide antenna in accordance with the present invention.

Referring now to the figures, wherein like reference numerals indicate like elements, in FIG. 1 there is shown a waveguide 10 of a wideband cavity-backed antenna in accordance with the present invention. In an exemplary embodiment of the present invention, the waveguide 10 is constructed in the shape of a box having a first side 12, a second side 14, a third side 16, a fourth side 18, a closed end 20 and an open end 22. The first side 12 and the second side 14 are substantially parallel to each other, and the third side 16 and the fourth side 18 are substantially parallel to each other. The sides 12, 14, 16, 18 and the closed end 20 form a waveguide cavity.

In an exemplary embodiment of the present invention, a port/feed point 24 is located between a first edge 21 and a second edge 23 of the third side 16 of the waveguide 10. A radiator element 26 is positioned within the cavity, and extends from an inner conductor 28 of a coaxial feed line 30 positioned at the feed point 24 of the waveguide 10. A flange portion 29, for example, in the shape of a disk, may be utilized to couple the coaxial feed line 30 to the waveguide 10.

The radiator element 26 is a spherical shaped metallic structure that is coupled to the inner conductor 28. The radiator element 26 may have a receptacle for receiving the inner conductor 28. The spherical design of the radiator element 26 provides for simplicity in the manufacturing of the radiator element 26, and accordingly, a radiator element 26, in accordance with the present invention is less expensive to manufacture than a the wideband cavity-backed antenna as disclosed in U.S. Pat. No. 6,150,988 incorporated herein in its entirety by reference.

Figure 2:
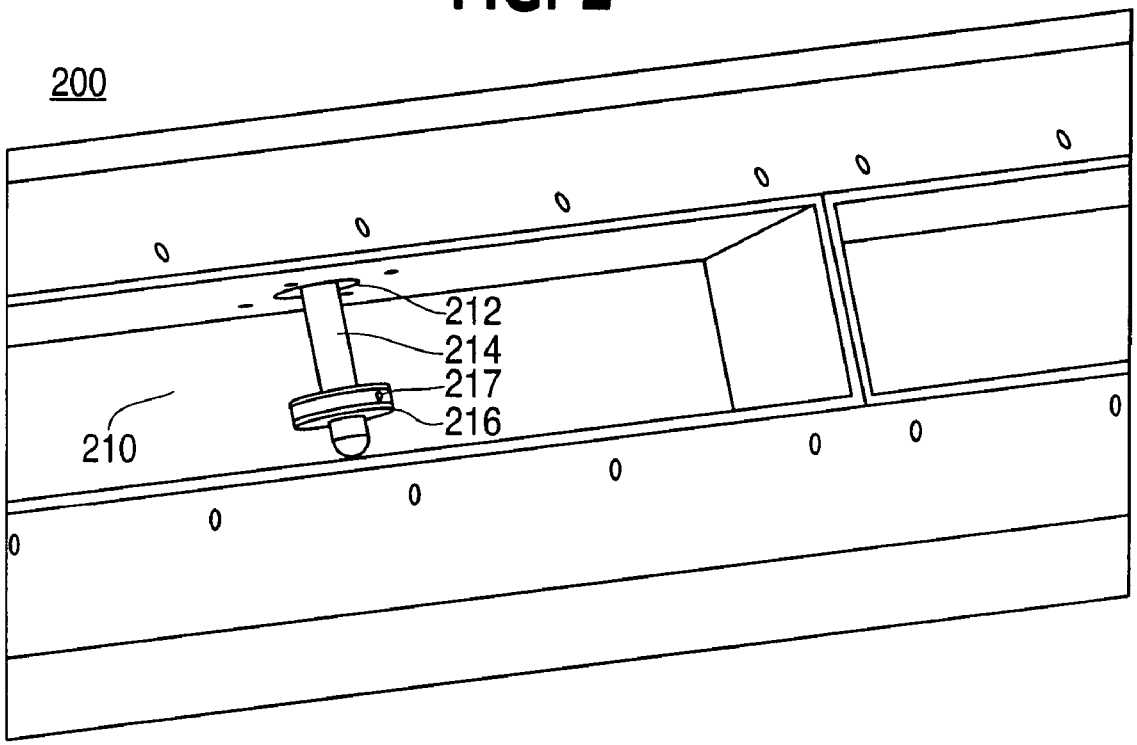
FIG. 2 is a perspective view of another radiator element for the wideband cavity-backed waveguide antenna of FIG. 1.

FIG. 2 illustrates another exemplary embodiment 200 of this invention using a puck-like radiator. Similar to the waveguide illustrated in FIG. 1 above, this exemplary embodiment 200 contains the waveguide 210 and an aperture 212, and protruding center conductor line 214. Rather than using a spherical radiator element 26, the exemplary embodiment 200 utilizes a puck-like radiating element 216 which is attached to the center conductor 214 via a tightening screw 217. Due to the tightening screw 217, the puck-like radiator 216 can be slid into various positions on the center conductor 214. By adjusting the position of the puck-like radiator 216 on the coaxial center conductor 214, the coupling of the electromagnetic energy radiated by the puck-like radiator 216 can be adjusted for increased efficiency or tuning of the waveguide 210. Based on the frequency and the orientation of fields generated by the puck-like radiator 216, the center conductor 214 may extend nearly the whole width of the waveguide 210. Alternatively, the center conductor 214 may be shortened or even "bent" to provide access to a different excitation point in the waveguide 210 than at the feed point 24.

It should be appreciated by one of ordinary skill in the art that the puck-like radiator 216 may have a slightly different shape than as shown in FIG. 2, as according to design preferences. For example, a prolate spheroid may be used as the radiating element or a structure having at least one plane containing a circular contour.

Figure 3:
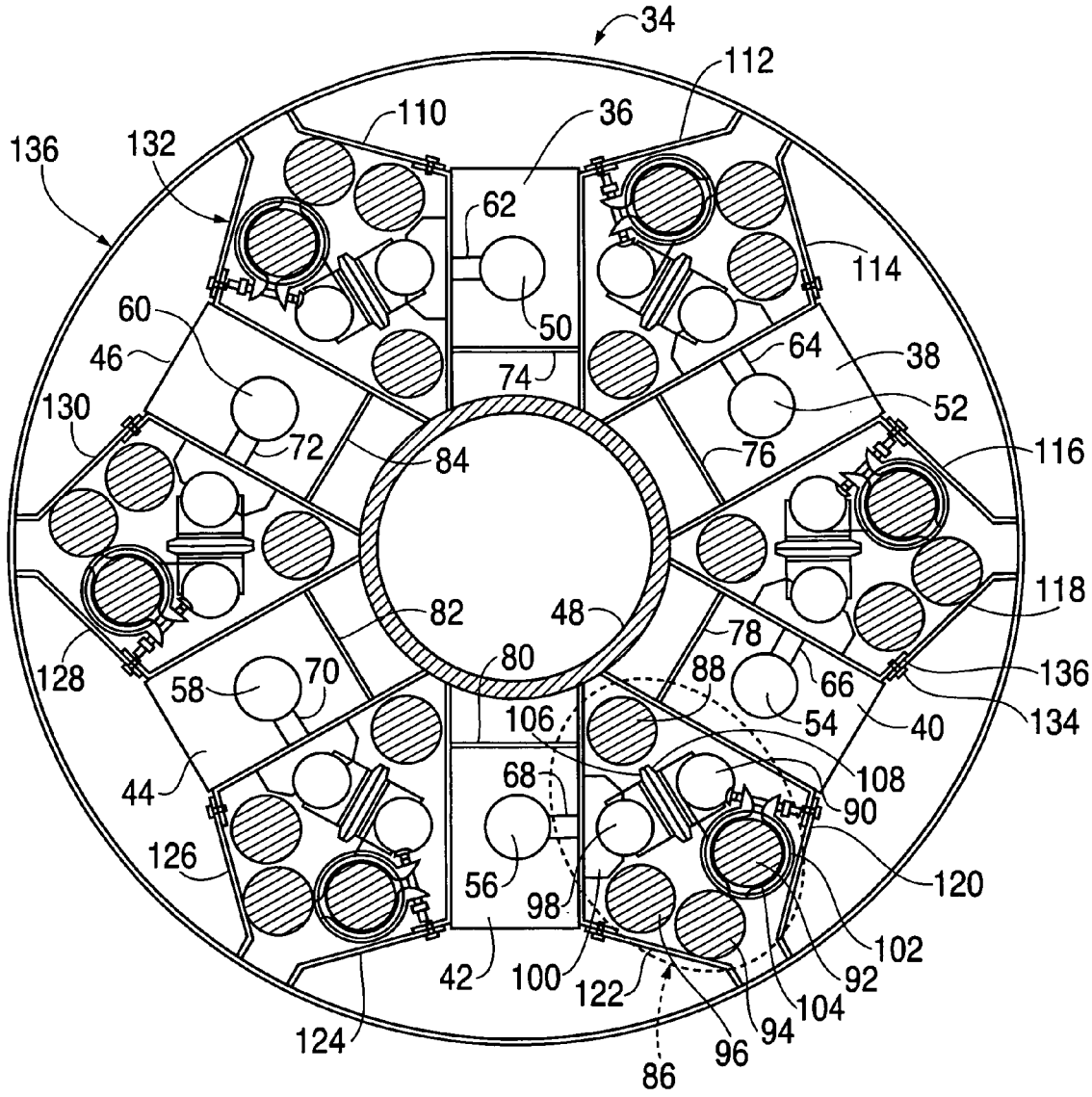
FIG. 3 is a top cross-sectional view of a wideband cavity-backed antenna in accordance with the present invention.

Shown in FIG. 3 is a top view of a wideband cavity-backed antenna 34 in accordance with the present invention. Six waveguides 36-46 are positioned around a hollow cylindrical steel mast 48. The waveguides 36-46 are, typically, smaller than panel antennas. Accordingly, the surface area of the waveguides 36-46 is less than that of panel antennas, and an antenna 34 in accordance with the present invention may be susceptible to less windload than a panel antenna.

Further, more waveguides 36-46, which contribute to the direction and shape of an antenna's azimuth pattern, than panel assemblies, can fit around a mast 48. Accordingly, an antenna 34 in accordance with the present invention has greater flexibility in shaping the overall azimuth pattern than a panel antenna.

Radiator elements 50-60, coupled to feed lines 62-72, are positioned within the cavity of each waveguide 36-46. Waveguide shorts 74-84 may be positioned within each waveguide 36-46 to define the transmitting frequencies of each waveguide 36-46.

Components of an external feed system 86, for example, feed lines 88-98, power divider 100, clamp 102, seal 104, and flanges 106, 108, for coupling, for example, feed lines 100 and 102, are positioned external to the mast 48 and between adjacent waveguides 36-46.

In an exemplary embodiment of the present invention, a conductive fin 110-132 is coupled to, for example, an upper edge, i.e. an edge along the open end, of the third side 16 and fourth side 18 of each waveguide 36-46, via a coupling mechanism 134, that includes, for example, a nut and bolt. A coupling portion 136 may be coupled to or formed continuously with a side 16,18 of each waveguide 36-46 for coupling each waveguide 36-46 to a conductive fin 110-132.

The conductive fins are utilized to shape the azimuth pattern generated from each waveguide 36-46, and to provide a protective cover for components of the external feed system 86. A radome 136 may be positioned around the antenna 34 to protect the antenna 34 from environmental conditions, such as rain, ice and snow, which could interfere with signal transmission.

A wideband cavity-backed slot antenna 34, in accordance with the present invention, is designed such that the waveguides 36-46 are positioned around mast 48, and the components of the external feed system 86 are positioned between adjacent waveguides 36-46 and under adjacent fins 110-132.

By simply uncoupling the fins 110-132 near the part of the external feed system 86 requiring service, an antenna 34 in accordance with the present invention can be easily serviced without removing and disassembling the antenna 34. Accordingly, an antenna 34 in accordance with the present invention is unlike the conventional waveguide cavity-backed slot antenna discussed herein that requires the antenna to be dismounted from a supporting structure and disassembled to reach its feed system for servicing.

In addition, the design of conventional wideband cavity-backed antennas require the waveguides to be physically in contact with each other, i.e. touch, to form the antenna structure, and thus, there is mutual coupling i.e., current flow between the waveguides.

Antenna design engineers, in anticipation of the effect that the mutual coupling will have on the ability of each waveguide to transmit particular frequencies, tune the waveguides, by adjusting the geometry of the waveguide, such that the waveguide is able to transmit signals of desired frequencies. However, an antenna 34 designed in accordance with the present invention provides advantages over the conventional design, because the waveguides 36-46 are positioned around the mast 48, such that there is a space between each waveguide 36-46. Further, the conductive fins 110-132, coupled to each waveguide 36-46, serve as a path for current to flow away from each waveguide 36-46. Accordingly, it is not necessary to design a waveguide 36-46 in anticipation of mutual coupling.

Figure 4:
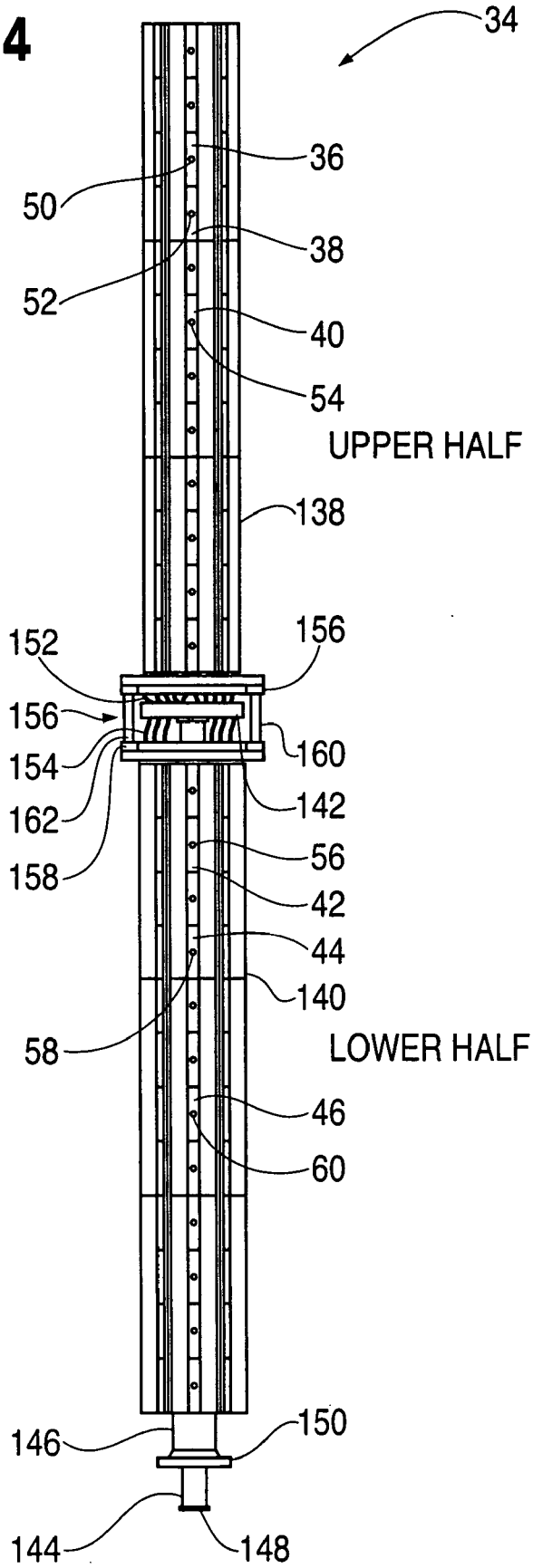
FIG. 4 is a front elevation view of a wideband cavity-backed antenna in accordance with the present invention.

Shown in FIG. 4 is an elevated front view of a wideband cavity-backed antenna 34 in accordance with the present invention. In an exemplary embodiment of the present invention, the antenna 34 is divided, for example, into an upper half 138 and a lower half 140. Each half 138, 140 of the antenna 34 is fed from a main power divider 142 positioned between the upper half 138 and the lower half 140 of the antenna 34.

A coaxial feed line 144 is provided within a structural steel mast 146 to feed the main power divider 142. The coaxial feed line 144 extends from an input 148 to the antenna 34 to the main power divider 142 positioned at or near the center of the antenna 34.

The input 148 to the antenna is below a base flange 150 of the mast 146. The main power divider 142 splits the signal among upper feed lines 152, which feed for example, waveguide cavities 36-40 positioned about the upper half 138 of the antenna 34, and lower feed lines 154, which feed for example, waveguide cavities 42-46 positioned about the lower half 140 of the antenna 34.

In an exemplary embodiment of the present invention, the main power divider 142 is positioned within a structural support 156 that is positioned between the upper half 138 and the lower half 140 of the antenna 34. The structural support has an open design and is constructed from two horizontal members 156, 158 and two vertical members 160, 162. The openness of the structural member allows the main power divider 142 to be easily accessed for service.

Figure 5:
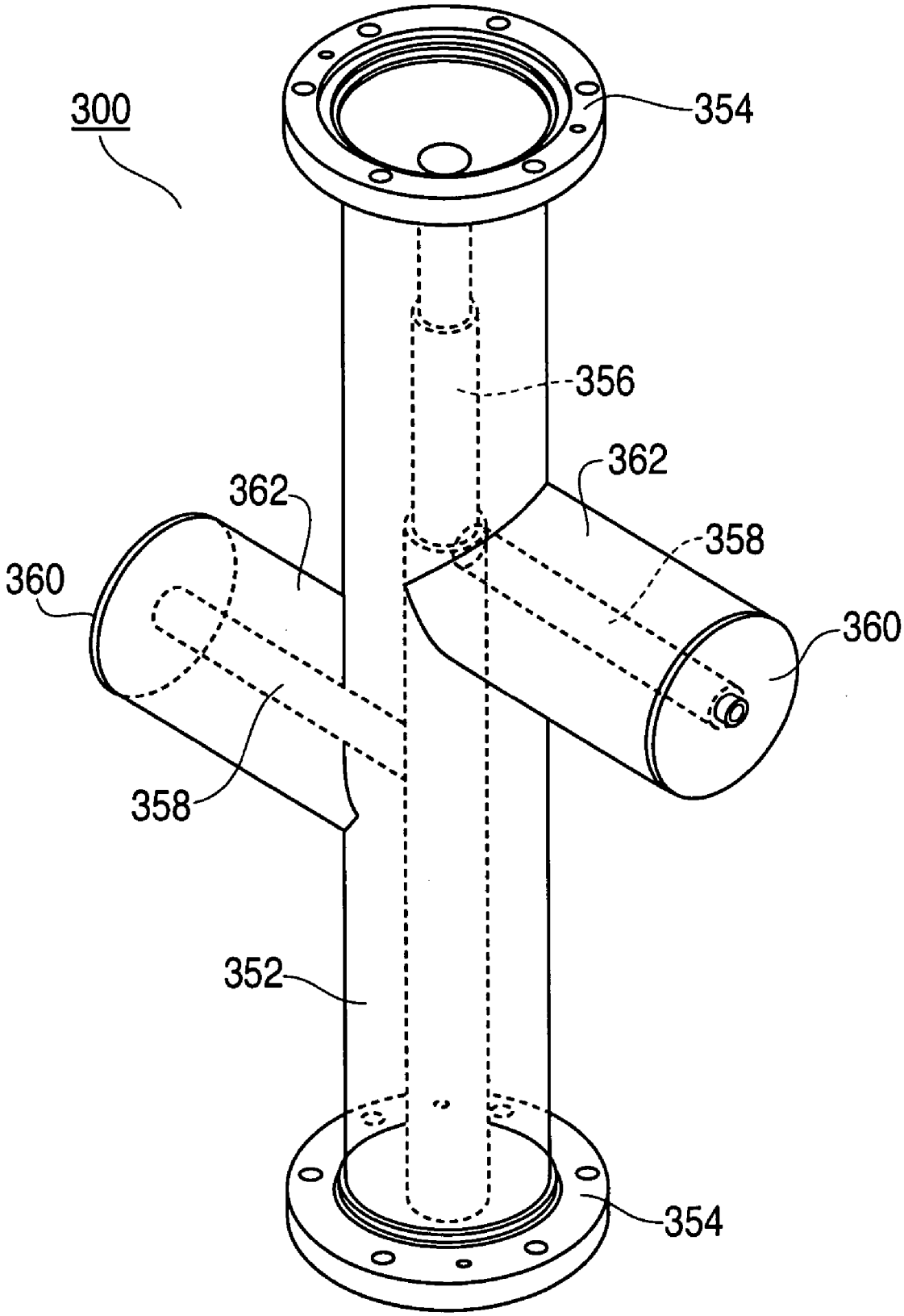
FIG. 5 is a perspective view of a DC grounding system suitable for the radiator elements of the present invention.

FIG. 5 is a diagram illustrating an exemplary DC grounding structure 300 for the exemplary antenna systems of this invention. To avoid DC static or voltage buildup on the radiating elements described above, a DC grounding structure 300 is described that enables convenient coupling between the radiating element(s) and the feed line(s)/transmission line(s), while providing a DC path to ground. The exemplary DC grounding structure 300 contains an outer casing 352 flanked by flanges 354 for mating to the transmission line at a point exterior from an antenna array. Preferably, but not necessarily, the mating may occur under the antenna array near the top of the tower. For example, for the arrangement shown in FIG. 4, the exemplary DC grounding structure 300 may be placed at the coaxial feed line 144. A center conductor 356 is provided within the outer casing/outer conductor 352 that is coupled to the transmission line's center conductor.

Stub tuning elements 360 are attached to the center conductor 356 via tuning arms 358. The end plates of the stub tuners 360 are secured to casing/outer conductor arms 362 which are connected to the central casing/outer conductor 352 which is grounded. The length of the stub tuners 360 are designed to appear as open circuit terminated transmission lines for the frequencies of operation of the antenna, thereby blocking AC signals from traveling to the grounded outer conductor 352. Conversely, the stub tuners 360 appear as short circuits to DC signals, enabling shorting to ground of the DC signals.

The DC grounding structure 300 can be placed anywhere between a transmitter and the antenna. Therefore, the DC grounding structure 300 provides a convenient and simple mechanism for establishing a DC ground to the antenna radiators. It should be appreciated, however, that alternative schemes for accomplishing the exemplary DC grounding structure 300 of this invention may be accomplished by using only one stub tuner or more than two stub tuners, as necessary. Furthermore, while the DC grounding structure 300 illustrates circular flanges 354 and circular casing/outer connector 352, alternative mounting structures or shapes may be used to accomplished the intended purpose.

Figure 6:
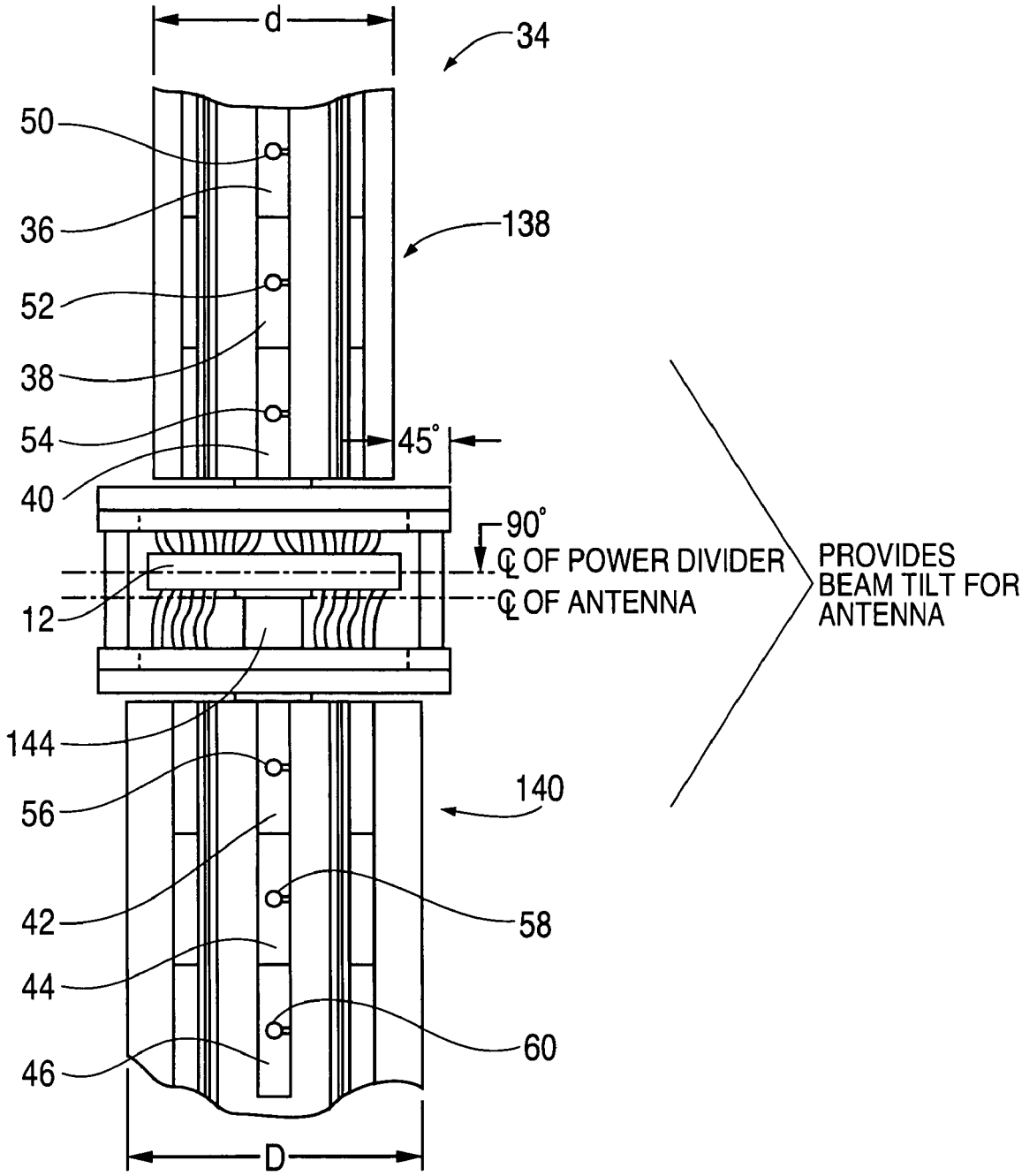
FIG. 6 is a partial front elevation view of a wideband cavity-backed antenna that illustrates impedance matching in accordance with the present invention.

Shown in FIG. 6 is a partial elevated front view of a wideband cavity-backed antenna 34 in accordance with the present invention to illustrate impedance matching. In an exemplary embodiment of the present invention, the antenna 34 is fed off from a center line of the antenna 34, such that signal power to the lower half 140 is fed ninety degrees out of phase with the upper half 138 of the antenna 34, and the impedance of the upper half of the antenna 138 cancels out the impedance of the lower half of the antenna 140.

The impedance of the upper half 138 will cancel out the impedance of the lower half 140 because the value of impedance at a point along an antenna will repeat itself at the completion of the transmission of one half of a wavelength of a sinusoidal signal, i.e. every one hundred eighty degrees. Thus, like a sinusoidal signal waveform, the values of impedance ascend from a starting point to a peak at ninety degrees and descend from the peak at ninety degrees to the starting point one hundred eighty degrees later, before impedance values repeat themselves.

Accordingly, the values of impedance from zero to ninety degrees, where the sinusoidal signal waveform reaches its peak, are equal and opposite to the values of impedance from ninety degrees to one hundred eighty degrees when the sinusoidal signal waveform descends from its peak.

By transmitting the signals from the lower half 140 of the antenna ninety degrees out of phase with the upper half 138 of the antenna 34, the values of impedance of the lower half 140 correspond to the values of impedance descending from ninety degrees to one hundred eighty degrees, i.e., the values of impedance that are equal and opposite to the values of impedance of the upper half, which correspond to the values of impedance ascending from zero degrees to ninety degrees.

As a result, the impedance of the upper half of the antenna 138 has a canceling effect on the impedance of the lower half 140, and the need to utilize capacitive disks or ground rods to facilitate impedance matching is eliminated. Thus, unlike the conventional antenna discussed herein, an antenna 34, in accordance with the present invention, does not require a capacitive disk and ground lines to accomplish impedance matching. As a result, an antenna 34, in accordance with the present invention, is less costly to manufacture.

In addition, an antenna 34 in accordance with the present invention has greater power handling capabilities an air gap between a capacitive disk and a waveguide is not required for impedance matching. Thus, an antenna 34 in accordance with the present invention is not limited to the amount of power that the air gap can withstand without breaking down.

In an exemplary embodiment of the present invention, it is desirable to achieve a predetermined beam tilt amount of one degree. However, it should be understood by one of ordinary skill in the art that the desired amount of beam tilt may vary.

To accomplish a beam tilt of one degree, the signal transmitted from the lower half 140 of the antenna 34 should, for an exemplary design of an antenna 34 in accordance with the present invention, lag the signal transmitted from the upper half 138 by forty-five degrees.

To achieve the desired beam tilt, without changing the feed phase difference of ninety degrees utilized for impedance matching, the space phase of the lower half of the antenna 140 is altered by increasing the overall diameter of the lower half of the antenna 140 to an amount that causes the signals transmitted from the lower half 140 of the antenna 34 to effectively lag the upper half 138 by forty-five degrees instead of ninety degrees.

By changing the diameter of the lower half 140 of the antenna 34, the starting point of signal transmission from the lower half 138 is advanced because the increase in diameter moves the antenna closer to the receiving point of the signal. Accordingly, by changing the space phase, beam steering of an antenna 34 in accordance with the present invention is accomplished without changing the feed phase, and thus, without changing the impedance matching characteristics of the antenna 34.

It should be understood by one of ordinary skill in the art the components of an antenna 34 may vary, for example, the number of waveguides 36-46 and the number of feed lines 88-98 may vary. It should also be understood by one of ordinary skill in the art that the design of the feed system of an antenna 34 in accordance with the present invention may vary.

Figure 7:
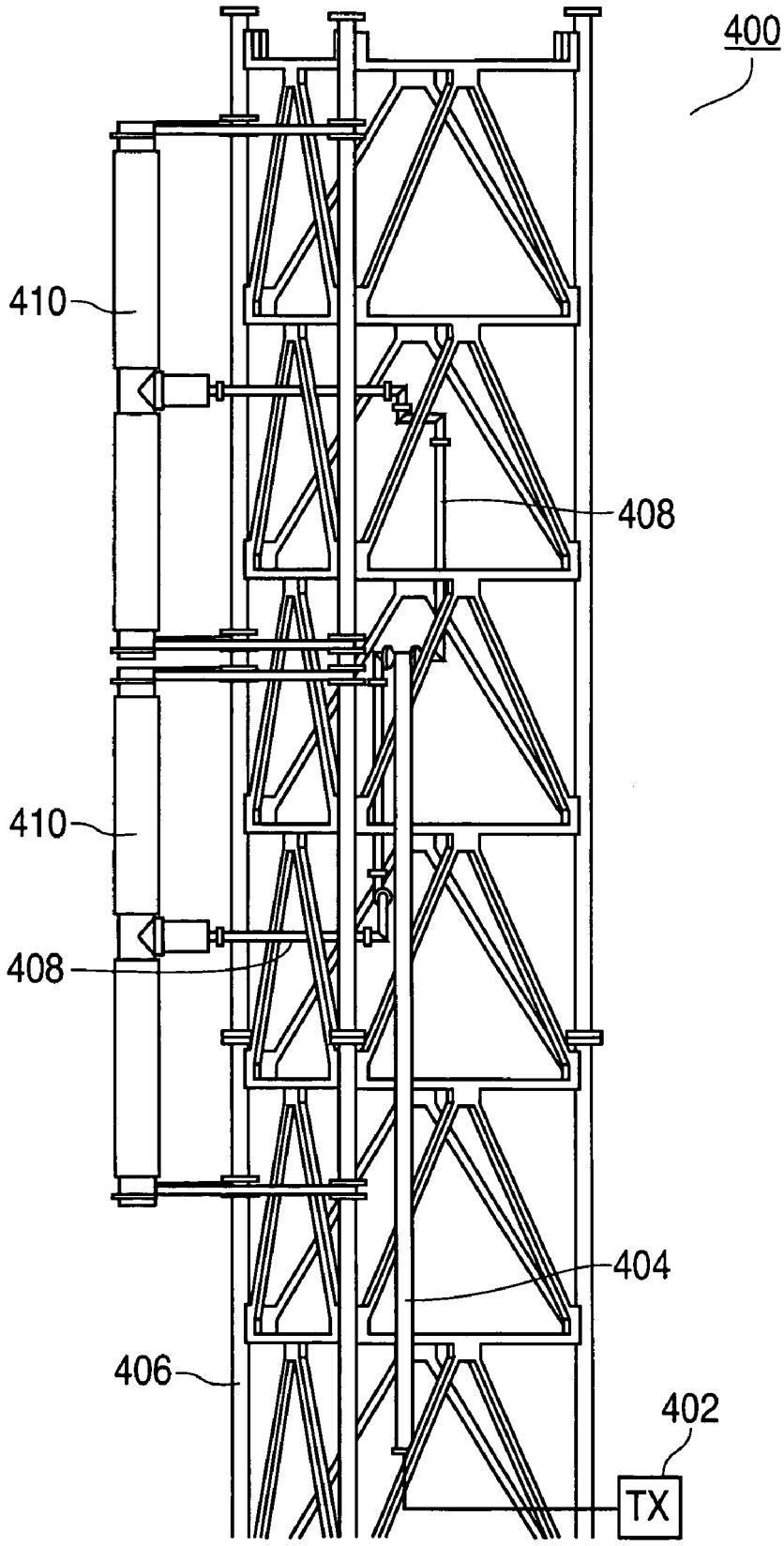
FIG. 7 is an illustration of a broadcast system implementing the wideband cavity-backed waveguide antenna system in accordance with the present invention.

FIG. 7 is a diagram illustrating one example of a broadcast system 400 utilizing the exemplary systems and methods according to this invention. A broadcast frequency transmitter 402 generates broadcast signals that are transmitted via a transmission line 404 to a broadcast tower 406. The broadcast tower 406 is accommodated with exemplary wideband cavity-backed antennas 410 about the tower 406, and the exemplary antennas 410 are fed via feed lines 408 which connect the transmission line 404 to the exemplary antennas 410. The exemplary DC grounding mechanism described herein may be situated at the base of the exemplary antennas 410 or at any point between the base of the exemplary antennas 410 and the transmitter 402. It should be appreciated that FIG. 7 illustrates only one of numerous possible implementations of the exemplary systems and methods described herein. For example, only one exemplary antenna array 410 or more than two exemplary antenna arrays 410 may be used. Additionally, several transmitters 402 may be used to transmit multiple signals to the tower 406.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna system, comprising:

a cavity-backed broadside radiating waveguide, wherein the cavity-backed waveguide is a boxlike structure having a first side and a second side that are parallel to one another, a third side and a fourth side that are parallel to one another, a closed end, and an open end, and wherein the cavity is the interior volume formed by the sides and the closed end of the waveguide;

a center conductor of a coaxial feed protruding through a side wall of the waveguide and into the cavity of the waveguide, wherein the side wall is any of the first, second, third, and fourth sides of the waveguide; and a radiating disc element having an axis of rotational symmetry substantially perpendicular to the side wall of the waveguide, wherein the radiating disk element is affixed to the center conductor, and wherein a position of the radiating disc element on the center conductor is adjustable.

2. The antenna system of claim 1, wherein the position of the radiating disc element is adjustably positioned via a tightening screw.

3. The antenna system of claim 1, wherein the center conductor protrudes through a center of the side wall.

4. The antenna system of claim 1, wherein the radiating disc has one surface that is hemispherical.

5. The antenna system of claim 1, further comprising:

a DC grounding structure, wherein the grounding structure comprises:

a grounded outer casing;

an inner conductor interior to and coaxial with the outer casing;

mounting flanges at each end of the outer casing; and at least one stub tuner, wherein a first end of the at least one stub tuner is affixed substantially perpendicular to the inner conductor and a second end of the at least one stub tuner is affixed to the outer casing.

6. The antenna system of claim 5, wherein the second end of the at least one stub tuner is affixed to a substantially perpendicular casing arm protruding from the outer casing.

7. An antenna system, comprising:

an antenna support tower;

an antenna mast attached to the tower;

a cavity-backed broadside radiating waveguide attached to the mast, wherein the cavity-backed waveguide is a boxlike structure having a first side and a second side that are parallel to one another, a third side and a fourth side that are parallel to one another, a closed end, and an open end, and wherein the cavity is the interior volume formed by the sides and the closed end of the waveguide;

a center conductor of a coaxial feed protruding through a side wall of the waveguide and into the cavity of the waveguide, wherein the side wall is any of the first, second, third, and fourth sides of the waveguide; and a radiating disc element having an axis of rotational symmetry substantially perpendicular to the side wall of the waveguide, wherein the radiating disk element is affixed to the center conductor, and wherein a position of the radiating disc element on the center conductor is adjustable.

8. A method for exciting a cavity-backed broadside radiating waveguide, comprising the steps of:

placing a center conductor of a coaxial feed through a side wall aperture of the waveguide;

attaching a radiating disc element to the center conductor;

adjusting a position of the radiating disc element on the center conductor to enable proper excitation of radiating fields; and energizing the radiating disc element with a time-harmonic electrical signal.

9. The method of claim 8, further comprising the step of:

providing a DC ground for the center conductor by using shorted stub tuners within a transmission line feeding the waveguide.

* * * * *